US007959029B2

(12) United States Patent
Whitaker et al.

(10) Patent No.: US 7,959,029 B2
(45) Date of Patent: Jun. 14, 2011

(54) SPLASH AND SPILL RESISTANT INSULATING LID

(75) Inventors: Craig Whitaker, Fairfield, OH (US); Van T. Walworth, Lebanon, TN (US); David B. Hook, Franklin, TN (US); Robert L. Edwards, Mesa, AZ (US); Clifford W. Bagwell, Springville, AL (US)

(73) Assignee: Aslan Guild, LLC, Brentwood, TN (US)

( * ) Notice: Subject to any disclaimer, the term of this patent is extended or adjusted under 35 U.S.C. 154(b) by 650 days.

(21) Appl. No.: 11/972,309

(22) Filed: Jan. 10, 2008

(65) Prior Publication Data

US 2008/0257899 A1 Oct. 23, 2008

Related U.S. Application Data

(60) Provisional application No. 60/879,935, filed on Jan. 12, 2007.

(51) Int. Cl.
*A47G 19/22* (2006.01)

(52) U.S. Cl. ..... 220/719; 220/717; 220/713; 220/711; 220/254.1; 215/387

(58) Field of Classification Search ..... 215/307, 215/308, 309, 387; 220/254.1, 254.7, 256.1, 220/367.1, 373, 374, 368, 369, 503, 521, 220/713, 7, 17, 719, 716, 731; 222/424, 222/564, 571

See application file for complete search history.

(56) References Cited

U.S. PATENT DOCUMENTS 4,331,255 A * 5/1982 Fournier ..... 220/257.2
4,619,372 A * 10/1986 McFarland ..... 220/713
5,540,350 A * 7/1996 Lansky ..... 220/380
5,542,670 A 8/1996 Morano
6,199,711 B1 * 3/2001 Lansky ..... 220/255
6,216,904 B1 4/2001 Cagan
6,296,141 B1 10/2001 Lukacevic
6,305,571 B1 10/2001 Chu
6,318,584 B1 * 11/2001 Milan ..... 220/713
6,325,236 B1 12/2001 Wong
6,488,173 B2 12/2002 Milan
6,533,139 B2 3/2003 Lukacevic
6,578,726 B1 * 6/2003 Schaefer ..... 220/253
6,811,049 B2 11/2004 Lukacevic
6,889,859 B1 * 5/2005 Leon ..... 220/254.3
6,923,337 B2 * 8/2005 Hession et al. ..... 220/714
7,134,570 B1 * 11/2006 Heath et al. ..... 220/717
2003/0089713 A1 * 5/2003 Belt et al. ..... 220/253
2004/0232154 A1 * 11/2004 Smith et al. ..... 220/713
2005/0098581 A1 * 5/2005 Long et al. ..... 222/190

(Continued)

*Primary Examiner* — Anthony Stashick
*Assistant Examiner* — Brett Edwards
(74) *Attorney, Agent, or Firm* — Harness, Dickey & Pierce, PLC

(57) ABSTRACT

A splash and spill resistant insulating lid for beverage containers comprising an insulated splash and spill barrier integrated into a cup lid combination. This is achieved by creating a barrier and/or labyrinth flow path, which buffers and deflects sloshing liquid. Accidental/incidental release of liquid is minimized and/or prevented while allowing the normal flow of liquid for drinking. These features of the SSRIL further create an insulating barrier to keep a cup's fluid hotter or cooler for a longer period of time, enhanced by using an appropriate insulating material combined with finite number of transfer holes that are of a specific shape and/or specific location and/or specific orientation to promote the formation of a surface tension film of fluid across the transfer holes, creating additional barriers against the escape and exchange of both fluid and vapor outside the cup.

20 Claims, 5 Drawing Sheets

U.S. PATENT DOCUMENTS

2006/0096983 A1* 5/2006 Patterson ..... 220/253
2006/0124645 A1* 6/2006 Peitersen ..... 220/374
2008/0011762 A1* 1/2008 Boone ..... 220/713
2008/0156802 A1* 7/2008 Yauk et al. ..... 220/253
2008/0156817 A1* 7/2008 Roseblade et al. ..... 220/713
2009/0050641 A1* 2/2009 Ivey ..... 220/713
2009/0065518 A1* 3/2009 Carnevali ..... 220/711
2009/0108006 A1* 4/2009 Milan ..... 220/592.17

* cited by examiner

SPLASH AND SPILL RESISTANT INSULATING LID

CROSS-REFERENCE TO RELATED APPLICATIONS

This application claims the benefit of U.S. Provisional Application No. 60/879,935 filed on Jan. 12, 2007. The disclosure of the above application is incorporated herein by reference.

FIELD

The present disclosure relates generally to a device for preventing splashing and/or spilling of a beverage from a container. More specifically, it is a device for preventing beverage splashes and/or spills from cups having lids with open sip holes, such as a coffee cup a consumer receives at point of purchase retail outlets similar to Starbucks, Dunkin Donuts, 7-Eleven, McDonald's, airline service, et cetera. Applications include hot beverages and cold beverages. Additional applications of the invention also include microwave soups and liquids that require being heated and/or reheated.

BACKGROUND

The statements in this section merely provide background information related to the present disclosure and may not constitute prior art.

In the marketplace today, many hot and cold beverages are served on a daily basis in disposable cups, many with disposable lids and some without lids. The lid acts as a sealer, attempting to ensure that the beverage stays within the cup, thus preventing excessive spillage of the beverage. Many disposable lid designs include a small sip hole to facilitate the drinking of a beverage without removing the lid, thereby maintaining the seal between the cup and lid.

Consumers often purchase a beverage and then walk or drive to another distant location while enjoying the beverage. Despite the care and consideration when consuming the drink, unexpected jostling and/or shaking often occur, resulting in splashing of the fluid from the cup. In addition, it is a common occurrence for the cup to be accidentally tipped over and/or turned on its side, causing spilling of fluid from the cup. The previous scenarios are accentuated in the case of a full cup, wherein even slight sloshing back and forth of the beverage results in the hot or cold beverage splashing out of the sip hole, possibly causing a serious burn to the consumer. When the consumer is driving in a vehicle, a small splash of a hot beverage may cause a serious accident, a burn to the consumer, a stain to the consumer's clothing, or a stain in the upholstery of the vehicle.

Even in the best of situations where the consumer is sitting down and/or in a stationary position to enjoy the beverage, it is a commonplace experience for an unexpected situation to occur, which results in the beverage cup tipping over and/or being turned on its side and creating a virtually instantaneous spilling of fluid from the cup. Even the fastest reflexive responses are seldom fast enough to catch or capture the tipped over cup in time to prevent spillage.

These previous scenarios are compounded exponentially when there is no lid to prevent splashing or spilling of the liquid. With the increase of the pace of contemporary lifestyles, the "to-go" mentality has necessarily become commonplace. As a result, drive-through food and, more importantly for the purpose of this present disclosure, drive-through beverage services are now an integral part of life.

There is a real and present need for a device or vessel that will enable the safe consumption of hot beverages, both during transit and/or stationary scenarios, while virtually eliminating splashing of fluid resulting from typical and conventional usage. In addition, there is a real and present need for a device or vessel that delays egress of the flow through the sip hole long enough to enable the consumer to reflexively respond fast enough to capture and/or catch the cup and correct its orientation with little or no spillage.

A significant amount of litigation, with judgment awards ranging into the millions of dollars for legal fees and settlements, has resulted from personal burn injuries caused by hot beverage spillage. Moreover, liability insurance costs for food and beverage vendors, as well as across the board increases in insurance premiums, have become a consequential reality.

Considering there are billions of to-go beverage containers sold each year, a number which is steadily increasing annually, burn and/or spillage exposure is obviously quite significant. In spite of the splash and spill issues related to hot beverages, consumers desire hotter beverages rather than less warm service temperatures. Vendors are pressured to provide consumers with very hot beverages, risking further exposure to splash and spill and burn incidents.

Traditional beverage containers provide little or no insulation value resulting in loss of temperature of the beverage before the beverage has been consumed, resulting in consumer displeasure with the drinking experience.

Many to-go containers attempt to address the insulation loss by using two cups, one nested down inside the other. Another extra insulation method is to employ various external sleeves on the outside of the cup. Both of these methods and variations of them may improve relative heat loss of the beverage through the cup, but do not address any heat loss through the lid. Therefore, loose disc-like products attempt to provide a secondary thermal barrier layer above the fluid and then additionally attempt to improve the efficiency of the secondary thermal barrier by sealing the passage holes with a film of surface tension fluid.

There is a real and present need for a device or vessel that will enable the safe consumption of hot beverages while at the same time maintaining a relatively elevated temperature of the beverage and minimizing heat loss through the lid.

Additionally, when spilled, the vast majority of hot beverages, most notably coffee and hot chocolate, can and do cause stains in clothing, automotive interiors, upholstery, carpet, et cetera, that, unless immediately and aggressively attended to, cannot typically be removed.

One attempt to address these problems is the Traveler Plus™ lid made by Solo. The Traveler Plus™ lid provides a user-initiated, separately attached sip hole cover under the lid to close the sip hole when the user is not drinking the beverage. The cover includes a latch that extends through a slot in the lid and, when pushed or pulled by a finger of the user, the cover swivels away from or toward the sip hole to open and close the sip hole.

Despite some apparent advantages, the Traveler Plus™ lid retains several disadvantages. Most notably the location of the latch is such that many users have difficulty holding the cup and accessing the latch with one hand. As a practical matter, most users find it necessary to hold the cup in one hand and open or close the latch with the other hand. In addition, lid products similar to the Traveler Plus™ require the consumer's head to tilt backward more and more as the cup approaches the final sips, resulting in a line of sight impediment, which is a driving safety hazard to those who enjoy their drink on the go.

Beverage drinkers often desire to drink beverages contained in a disposable cup while driving or holding another item in the other hand. Therefore, users often experience difficulties while drinking through the lid because of the dangerous and/or inconvenient use of both hands often required by the Traveler Plus™ lid and other similar products.

Therefore, there is a real and present need for a device or vessel that will prevent the splash of fluid through a sip hole of lids while holding the cup with a single hand. In addition, there is a real and present need for a device or vessel that allows the consumer to drink from the cup safely without requiring the consumer's head to tilt backward, as the cup approaches the final sips, and does not result in a line of sight impediment.

Furthermore, lids with complicated and complex lid designs, such as the Traveler Plus™ lid, are more difficult to nest and thus more expensive to distribute on a commercial scale. Because of the potential fallbacks of using a more complex disposable lid, many beverage retailers continue to use stackable lids with an uncovered sip hole.

The market is full of additional lid designs that attempt to address potential splash and spill issues related to consumer's handling beverages of one kind or another in one environment or another. Literally, billions and billions of lids each year are served to paying customers to cover a beverage.

U.S. Pat. No. 4,589,569 introduces a drink-through lid with a preformed opening for drinking, which is elevated above the rim of the beverage container. Even though this design prevents some of the spillage due to tilting and jarring, it still allows the beverage to splash on the consumer or the consumer's clothing, car, or other property. One disadvantage of the '569 patent is that hot liquid splashing out of the container can be an inconvenience as well as a safety hazard, causing burns, distractions, and stains. Another disadvantage of the '569 patent is that it provides no spill resistance when the cup is tilted or turned on its side. Another disadvantage of the '569 patent is that it does not provide any extra insulation value. Another disadvantage of the '569 patent is that relative heat loss is accelerated via the chimney effect through the elevated sip hole location. Another disadvantage of the '569 patent is that there is little or no splash resistance provided during the sipping action, should unexpected jostling or shaking occur.

U.S. Pat. No. 4,782,975 introduces an inner lid component that cooperates with the outer lid to provide a normally closed valve. The valve is only open via externally applied lip pressure. Disadvantages of this design include no improved thermal barrier. Another disadvantage of the '975 patent is that the flexibility required by the two cooperating components requires expensive materials, which make this product impractical for a one-time disposable product use market.

U.S. Pat. No. 5,143,248 introduces a complete inner lid layer cooperating with the outer lid. The inner layer can be rotated relative to the outer layer to close the sip hole. The '248 patent claims that, by varying the amount the sip hole is closed, one can vary the cool down rate of the beverage. One disadvantage of the '248 patent is that fluid is prevented from entering between the two lid layers and only passes directly through the sip hole. Another disadvantage of the '248 patent is that when the sip hole is open for drinking, no splash or spill resistance is provided.

U.S. Pat. No. 5,540,350 introduces a pair of disc lid layers that create a baffle fluid flow path. The lower lid layer has a series of holes while the upper lid layer allows fluid to pass around the outer perimeter. The '350 patent is a loose product that can be placed in a beverage vessel and used with a traditional lid. One disadvantage of the '248 patent is that the two-piece construction is a separate component for the consumer to place in a cup, which allows the opportunity for the component to be installed incorrectly or not at all. Another disadvantage of the '350 patent is that the loose component assembly can easily be tilted sideways in the cup during drinking and void the features it is claiming to provide.

U.S. Pat. Nos. 5,979,689 and 6,199,711 are variations on the theme of the '350 patent and add other improvements upon the '350 patent, such as resolving the loose disadvantage by making either the outer lid layer or the inner lid layer wrap around and attach to the cup lip. This improvement is further complicated by a very complicated series of flaps that is claimed to be normally closed and only activated by a rotatable layer. One disadvantage of the '711 patent is that, in addition to the cost of complexity, the material cost for a resilient flap that actually remains normally closed makes this product impractically expensive for the single use disposable marketplace.

U.S. Pat. No. 6,305,571 introduces an inner lid layer with some specifically located holes, allowing fluid to pass into a chamber directly under the sip hole and then returning the excess fluid down a ramp to a drain hole. The '571 patent claims to be "splashless;" however, the inner lid layer fastens to the outer lid layer at a central point of contact, which leaves the perimeter of the inner lid layer to be unconstrained. This unconstrained condition allows for lid component mismatch due to typical manufacturing and/or assembly tolerances, resulting is leakage around the perimeter of the inner lid layer, resulting in not-so-splashless performance. Another disadvantage of the '571 patent is that the lids are virtually unstackable against each other, resulting is increased storage space required by vendors and increased shipping costs due to less lids per unit box volume.

U.S. Pat. No. 6,311,863 introduces an aroma baffle that claims to enhance the beverage drinking experience. Whether this claim is true, disadvantages of the '863 patent obviate any potential aroma advantage. One disadvantage of the '863 patent is that the inner lid layer and downward extending baffle plate are not stackable, requiring excessive shipping and storage costs to the vendors. Another disadvantage of the '863 patent is that the cost of the excessively large downward extending baffle is impractical for a one-use disposable component. Another disadvantage of the '863 patent is that it provides little or no splash or spill resistance.

U.S. Pat. No. 6,578,726 claims a one or two-piece construction, albeit they do not disclose a method or drawing of a one-piece construction. The '726 patent claims that the lower lid portion may be used singularly in some applications without the second portion. One disadvantage to the '726 patent is that the aroma vents allow fluid to be resident and/or pool directly in the line of sight with the aroma exit hole, which does not provide splash or spill resistance. This lack of splash resistance is especially notable when the single portion is used by itself. Another disadvantage of the '726 patent is that the secondary lid portion is applied and snapped onto the inner lid portion from the outside of the lid, which allows it to pop off unexpectedly, not be assembled properly, or leak around the perimeter of the secondary portion.

U.S. Pat. No. 6,679,397 introduces a tethered closure tab that can seal the sip hole during transport. One disadvantage of the '397 patent is that the sip hole must be opened to sip, during which time there is no splash or spill resistance. Another disadvantage of the '397 patent is that the consumer must re-install the closure tab between sips to gain the advantage of the closure tab, which is a two-hand function and awkward for many consumer drinking experiences, resulting is consumers not re-installing the closure tab. Another disadvantage of the '397 patent is that it is not stackable, resulting in excessive vendor cost for storage and shipping. Another disadvantage of the '397 patent is that the tethered tab is dangling about the consumer, detracting from the beverage drinking experience.

U.S. Pat. No. 6,732,875 introduces a two-piece lid with the inner lid layer rotatable with respect to the outer lid layer via a finger tab or similar means. One disadvantage of the '875 patent is that the sip hole must be opened and closed between sips to take advantage of the splash resistant feature. Another disadvantage of the '875 patent is that for many people the sliding of the tab is a two-hand operation and awkward in many beverage drinking situations. Another disadvantage of the '875 patent is that, during sipping, the open sip hole exposes the consumer to splash and spill situations.

U.S. Pat. No. 7,063,224 introduces a lid with a tab that tilts back and secures in place. One disadvantage of the '224 patent is that during sipping the sip hole is open, exposing the consumer to spill and splash situations. Another disadvantage of the '224 patent is that once the tab has been tilted back and secured, no additional splash or spill resistance is provided to the consumer.

U.S. Pat. No. 7,086,549 introduces a reusable two-piece lid construction more specifically for spray paint cans used with air spray paint guns. A significant disadvantage of the '549 patent is that any variation on the theme is excessively expensive for any application in the disposable beverage drink market.

U.S. Pat. No. 7,100,790 introduces a single-piece lid with baffle openings that allow fluid to pass from the container into a reservoir on the other side of the lid. One disadvantage of the '790 patent is that fluid pooled in the reservoir is subject to splash and spill situations. Another disadvantage of the '790 patent is that fluid subjected to shaking and/or jostling has a clear line of sight into the reservoir from the container below, and there is no additional baffling or diverter means in the reservoir to absorb or dissipate fluid flow forces as they pass through the baffle openings and into the reservoir.

U.S. Pat. Nos. 7,131,551 and 7,134,566 are variations on the theme of the U.S. Pat. No. 6,679,397 tethered tab closures. One disadvantage of the '551 and '566 patents is that the sip hole must be opened to sip, during which time there is no splash or spill resistance. Another disadvantage of the '551 and '566 patents is that the consumer must re-install the closure tab between sips to gain the advantage of the closure tab, which is a two-hand function, and awkward for many consumer drinking experiences, resulting is consumers not re-installing the closure tab. Another disadvantage of the '551 and '566 patents is that it is not stackable, resulting in excessive vendor cost for storage and shipping. Another disadvantage of the '551 and '566 patents is that the tethered tab is dangling about the consumer, detracting from the beverage drinking experience.

U.S. Pat. No. 7,156,251 is a variation on the theme of U.S. Pat. No. 6,732,875. One disadvantage of the '251 patent is that the sip hole must be opened and closed between sips to take advantage of the splash resistant feature. Another disadvantage of the '251 patent is that for many people the sliding of the tab is a two-hand operation and awkward in many beverage drinking situations. Another disadvantage of the '251 patent is that, during sipping, the open sip hole exposes the consumer to splash and spill situations.

Another concept was conceived by Dan Roseblade and Ricky Anderson. Their product concept is hereinafter referred to as the "Disc." One embodiment of the Disc can be used independently in a typical hot beverage cup with a typical hot beverage sipping lid, while a second embodiment of the Disc is installed intermediately between a typical hot beverage cup and a typical hot beverage sipping lid for the purpose of minimizing seepage through the sip hole in the lid.

The Disc is a relatively flat plane device with a series of round holes perforating through the disc to allow passage of fluid from one side to the other. The relatively flat plane surface of the Disc is oriented such that the relatively flat surface is relatively parallel to the surface of the fluid when the cup is upright at rest. Whether the Disc is independent or installed intermediately into a lid, the relatively flat surface of the Disc maintains a relatively parallel orientation with the surface fluid when the cup is upright at rest.

One disadvantage of the Disc is that the independent embodiment allows the device to float on the fluid and/or remain loose in the cup, which allows differential orientation of the passage holes relative to the sip hole. The series of passage holes are allowed to be far enough away from the sip hole that line of sight orientation is possible with the sip hole, such that some incidental splash is possible.

Another disadvantage of the Disc is that the numerous series of holes provides a line of sight orientation with the sip hole at most every 360 degree orientation rotation of the Disc relative to the sip hole, such that some incidental splash is possible. This disadvantage is not overcome when the Disc is installed intermediately into a lid, due to the numerous series locations of the passage holes still providing a line of sight orientation with the sip hole regardless of the rotational orientation of the Disc relative to the sip hole.

Another disadvantage of the Disc is that the holes are preferred round in shape, which allows for the maximum volume of fluid to pass through relative to the circumference of the hole, allowing incidental splash to be at its maximum potential.

Another disadvantage of the Disc is that the relatively flat plane surface allows fluid to pass through from one side to the other and pool on the top side of the Disc without draining back into the cup, allowing this pooled fluid to rapidly cool down only to be mixed in with warmer fluid from the cup during a subsequent drink, thus minimizing the otherwise beneficial effects of the insulation value of the Disc portion. The Disc claims that surface tension will seal the passage holes and block the chimney effect of heat loss through the passage holes. While this may be true for the holes that have fluid in them, it is not true for the holes that do not have fluid in them. Another disadvantage of the Disc is that there are so many passage holes in the series, that it is virtually impossible for every hole to have fluid passing through it to form a surface tension thermal barrier unless the cup is turned upside down.

Another disadvantage of the Disc is that while some holes may form a thermal barrier, due to surface tension, the remainder of the unsealed holes allows for a rapid heat release accelerating through the open holes to balance thermal exchange, minimizing the benefit of the thermal barrier formed by the Disc.

Another disadvantage of the independent Disc embodiment is that it must be handled by the customer at the point of purchase and can be installed improperly or not installed at all, obviating any potential benefit.

Another disadvantage of the installed intermediate Disc in a lid is that the Disc can be easily removed; it can become dislodged during handling and/or transport, obviating any potential benefit.

Another disadvantage of the installed intermediate Disc in a lid is that lids of this design are not easily stackable, requiring the vendor to make special handling considerations, larger volume storage considerations, and less units per shipping box considerations.

Another disadvantage of the Disc is that during sipping, excessive line of sight is provided between the passage holes and the sip hole, during which time little or no spill or splash resistance is provided should any incidental jostling or shaking occur unexpectedly.

Another disadvantage of the Disc is that while the device does provide some benefit to minimize incidental splash of fluid through the sip hole when the cup is shaken or jostled, it provides little or no spill resistance when the cup is tipped and/or turned on its side.

Henceforth, there is a real and present need for a device or vessel that will prevent beverage splashing and/or spilling from disposable cup and lid combinations, while still allowing beverage retailers to retain the economical incentives associated with the use of more conventional stackable disposable lid designs.

When liquids, soups, and other similar foods are heated and/or re-heated in a microwave oven, there is a common experience by consumers that the lid pops off the container during heating and results in quite a mess to clean up in the oven. One reason for the lids popping off is the result of bits of food acting as projectiles that knock the lid off the container. Peas and beans often explode in response to microwave exposure, sending small food projectiles that impact against the inside the lid and knocking it loose.

Therefore, there is a real and present need for a lid device that will absorb and/or deflect the forces of the exploding food projectiles so that said forces are abated before they can dislodge the lid.

During extreme fluid jostling and/or violent shaking of a beverage container full of fluid, the fluid sets up a wave-like motion inside the container and slams against the inside of the lid. In many instances, the force of the wave motion is sufficient to dislodge the lid, resulting in a complete spill.

Therefore, there is a real and present need for a lid device that will absorb and/or deflect the forces of fluid wave motion inside the container to prevent said forces from acting directly upon the lid in such a way that it can become dislodged as a result of the fluid wave forces.

The subject invention satisfies all of the articulated real and present needs by providing a splash and spill resistant insulating lid design. Those skilled in the art will appreciate that conventional cup and lid combinations may be utilized in the marketplace that incorporate one or more of the various features of the subject invention.

SUMMARY

It is therefore an object of the present invention to provide a splash and spill resistant insulating lid (SSRIL) device, which provides a finite number of specifically located transfer holes to allow the fluid to pass through it and yet create a surface tension bubble barrier when not being consumed.

It is a further objective of the SSRIL to create an insulating barrier to keep the cup's fluid hotter or cooler for a longer period of time.

It is a further objective of the SSRIL to create an insulating barrier between the fluid and the atmosphere and therefore reduces the loss of heat.

It is a further objective of the SSRIL to provide one series of transfer holes designed to allow influent passage from the cup side to the lid side and a second series of transfer holes to allow effluent drain back to the cup.

It is a further objective of the SSRIL to prevent a line of sight between any influent or effluent transfer holes and the sip hole to prevent direct splash flow and/or direct spill flow paths.

It is a further objective of the SSRIL to provide surface channels and/or ramps to create proper flow from the influent transfer holes to the sip hole and/or back to the effluent drain transfer holes.

It is a further objective of the SSRIL to create surfaces and ramps that are not relatively parallel to the fluid surfaces when the cup is vertically at rest, thereby preventing pooling of fluid on the lid side of the SSRIL.

It is a further objective of the SSRIL that the device is not easily removable, rotatable relative to the sip hole, or independently handled by the consumer, thereby maintaining full design benefits at all times.

It is a further objective of the SSRIL to provide a finite number of transfer holes designed to minimize vertical splash from jostling or shaking while maximizing horizontal flow during sipping.

It is a further objective of the SSRIL to provide a labyrinth indirect flow path between the influent transfer holes and the sip hole to prevent relative instantaneous flow out of the sip hole, thereby providing a moment of delayed fluid egress when the cup is tipped or turned on its side unexpectedly, providing a chance for the consumer to capture or catch the cup and correct its orientation with little or no spillage from the cup.

It is a further objective of the SSRIL to provide a further labyrinth indirect flow should fluid manage to splash from the cup back through the effluent drain holes, preventing such action from making its way to the sip hole, by dissipating fluid energy via deflection channels, returning the fluid to drain, back through the same effluent holes it originally splashed through.

It is a further objective of the SSRIL to provide an outer layer with contours and shaped geometry that provides relief areas for the consumer's nose and upper lip to minimize incidental contact with the outer layer during the drinking experience, thereby allowing consumption of the beverage without requiring the consumer's head to tilt backward as the cup approaches the final sips, and does not result in a line of sight impediment.

It is a further objective of the SSRIL to provide influent and effluent holes designed to maximize the effects of surface tension sealing over the holes to maintain thermal barrier enclosure.

It is a further objective of the SSRIL to provide a series of influent transfer holes that are all exposed to fluid transfer during each sipping experience, thereby ensuring that each influent transfer hole is sealed with a thermal surface tension barrier as a function of the initial sip.

It is a further objective of the SSRIL to create a cooling chamber that ever so slightly cools the fluid after it passes into the chamber and just prior to emerging from the sip hole and touching the lips, while at the same time allowing the same chamber to provide a thermal insulation barrier to keep the fluid in the cup at an elevated temperature.

It is a further objective of the SSRIL to provide a means to ensure that every influent and every effluent transfer hole is sealed with a thermal surface tension barrier as a result of the initial sip, thereby ensuring a thermal insulation chamber between the SSRIL and the lid.

It is a further objective of the SSRIL to provide an inner lid layer that cooperates with the outer lid layer such that the location and shape of influent and effluent transfer holes on the inner lid layer are oriented and clocked with specific geometric-shaped structures on the outer lid layer. Said cooperation between the inner lid layer and the outer lid layer provides improved efficiency of absorbing and/or dissipating the force and/or advancement of fluid due to sloshing or splashing through the influent and/or effluent transfer holes.

It is a further objective of the SSRIL to provide specific geometry on the outer lid layer extending downward toward the transfer holes and/or extending upward away from them. Said geometry is designed to provide flow deflection and/or flow diverters and/or flow dividers to direct sloshing and splashing through the transfer holes, while at the same time still allowing free flow for sipping.

It is a further objective of the SSRIL to create a vapor pressure differential between the atmosphere immediately outside the sip hole (ATMOSpsi), the insulation chamber (SSRILpsi), and the air between the fluid mass in the cup on the underside of the SSRIL (CUPpsi), such that a vapor pressure differential can be expressed by:

$$ATMOSpsi<SSRILpsi<CUPpsi$$

It is a further objective of the SSRIL to create a thermal differentiation between the fluid immediately after egress from the sip hole (Tsip), fluid in the insulation chamber (Tins), and fluid in the cup (Tcup), such that a thermal differentiation can be expressed by:

$$Tsip<Tins<Tcup$$

It is a further objective of the SSRIL to provide a labyrinth of indirect flow between the influent transfer holes and the sip hole such that when the sipping action is complete, some fluid remains in the labyrinth flow path, and returns back to the effluent drain holes once the cup is returned to the vertical at rest position, thereby ensuring that all of the effluent drain transfer holes are sealed with a thermal surface tension barrier as a function of the initial sip.

It is a further objective of the SSRIL to provide influent transfer holes aligned at a specific orientation relative to the specific geometric transfer hole shape such that maximum flow is achieved when the cup is in the tilted position for sipping.

It is a further objective of the SSRIL to provide transfer holes shaped such that they minimize sloshing and splashing flow while still allowing maximum sipping flow. Said transfer hole shapes include, but are not limited to, elliptical holes, rounded triangular holes, narrow slot holes, crescent-shaped holes, asterisk-shaped holes, and various parabolic shaped holes.

It is a further objective of the SSRIL to provide a vent hole in the outer lid layer that is positioned over the internal effluent transfer drain holes such that escaping aroma can be transferred to and through the vent hole to the nose of the consumer to enhance the drinking experience.

It is a further objective of the SSRIL to ensure there are no passage holes located directly at bottom dead center of the SSRIL relative to the sipping tilt position such that sediment, coffee grounds, tea grounds, and the like are prevented from transfer into the insulation chamber, and are thusly retained in the cup.

It is a further objective of the SSRIL to provide an inner lid layer that absorbs and deflects the force of food projectiles, such as peas and beans, during activities such as microwave heating or reheating, preventing said projectile force from being applied directly against the outer lid layer.

It is a further objective of the SSRIL to provide an inner lid layer that absorbs and deflects the fluid force wave motion in the container, preventing said wave motion force from being applied directly upon the outer lid and rather that the wave motion force is applied to the radial hoop strength of the cup lip, resulting in a tighter fit and seal of the lid to the cup.

It is a further objective of the SSRIL that a conventional straw can be inserted through the sip hole of the outer lid layer and through a weakened area in the inner lid layer directly under the sip hole to allow use of a conventional straw without removing or replacing the lid.

These and other objectives will become apparent from the following disclosure and drawings describing the SSRIL, comprising an insulated splash and spill barrier that is integrated into a cup lid combination. This is achieved by creating a barrier and/or labyrinth flow path which buffers and deflects sloshing liquid. Accidental/incidental release of liquid is minimized and/or prevented while allowing the normal flow of liquid for drinking.

The construction features of the SSRIL further create an insulating barrier to keep a cup's fluid hotter or cooler for a longer period of time. This feature is enhanced by using an appropriate insulating material combined with a finite number of transfer holes that are of a specific shape and/or specific location and/or specific orientation to promote the formation of a surface tension film of fluid across the transfer holes, creating additional barriers against the escape and exchange of both fluid and vapor outside the cup. The greatest insulating value and result of this feature is a measurable reduction in the loss of heat, normally lost by way of the chimney effect.

This slight delay of fluid flow time in the chamber before emergence from the sip hole also provides a moment for the consumer to reflexively capture and/or correct the orientation of the cup in the event of an accidental tip-over of the cup, thus minimizing or avoiding spillage from the sip hole. While reflexive response time varies from consumer to consumer, at least there is a chance to minimize or eliminate spills that might otherwise have resulted from a tip-over event.

The SSRIL forms an insulation chamber between the fluid and the lid, formed by the lid side of the SSRIL and the underside of the outer lid portion. As fluid passes into and through the chamber, the fluid is slightly cooled in the chamber just prior to drinking, reducing the risk of burning. This is accomplished by a labyrinth flow path from the influent transfer holes toward the sip hole. The labyrinth delays the egress of the fluid from the chamber just long enough to make an ever so slight temperature drop in the fluid by consuming thermal energy and taking advantage of dissipative heat loss of a lesser fluid volume just prior to emergence from the sip hole.

The SSRIL creates a dual purpose chamber that provides both a "cooling chamber" as well as an "insulation chamber". As fluid passes into and through the chamber, the fluid is slightly cooled in the chamber preliminary to drinking, reducing the risk of burning. Additionally, the dual purpose chamber simultaneously provides an air pocket of restricted air circulation, which functions as an effective insulation chamber. The chamber is able to provide the function of an insulation chamber by having an inner layer that acts as an initial thermal barrier for the fluid in the cup or vessel. The fluid in the cup or vessel has a certain thermal mass. The thermal mass of the fluid is able to maintain a higher temperature by virtue of the initial thermal barrier provided by the inner layer.

The efficiency of the insulation chamber is enhanced via the use of a finite number of transfer holes to minimize the locations capable of chimney effect cooling. The efficiency of the insulation chamber is further enhanced via the use of specific shaped transfer holes that promote a film seal from surface tension formed as fluid passes through the transfer holes such that the film blocks further heat loss through the chamber.

Those skilled in the art understand there are many appropriate insulation materials the inner layer can be manufactured from, as well as numerous variants, available to the designer, to consider for a specific application, such as thickness of the inner layer, surface contours of the inner layer, number or transfer holes, shape and/or size of the transfer holes, geometry of the transfer holes with or without deflection barriers, and method of integration and/or cooperation of the inner layer with the outer layer.

As fluid in the thermal mass below the inner layer is jostled or sloshed, limited amounts of fluid is able to squirt, splash, or extrude through the transfer holes. The limited amount of fluid that does make its way through the transfer holes, due to sloshing, is prevented from having a direct flow path line of sight to and/or through the sip hole in the upper layer. Therefore, in addition to providing a cooling chamber and an insulation chamber, the chamber also provides a simple labyrinth, preventing a direct flow path from the thermal mass to the sip hole. By preventing a direct flow path from the thermal mass to the sip hole, laminar fluid flow is prevented, resulting in minimized and/or prevented incidental spillage.

The outer layer of the chamber provides a structure in which an attachment means for the lid containing the SSRIL fastens to a cup or vessel. The SSRIL does not propose any improvements to the attachment means of the outer layer; it simply employs standard prior art forms of attachment to suit specific applications.

The outer layer also provides an attachment means to retain the inner layer and secure it in place as a subassembly. The subassembly of the inner and outer layers behaves as a single lid unit, as far as the consumer is concerned. The subassemblies are designed to easily stack together in a nesting format to facilitate point of purchase storage and/or dispensing of lids.

The outer layer also includes contours and shaped geometry that provides relief areas for the consumer's nose and upper lip, to minimize incidental contact with the outer layer during the drinking experience. Relief areas for the upper lip and nose minimize physical contact with the outer layer so that direct contact between the consumer's nose and/or upper lip against the outer layer can be avoided as well as incidental human contact with a relatively hot outer layer surface. The relief area will allow consumption of the beverage without requiring the consumer's head to tilt backward as the cup approaches the final sips, and does not result in a line of sight impediment.

The SSRIL provides an insulation chamber which creates a thermal differential between the fluid mass in the cup, the fluid flowing in through the insulation chamber, and the fluid immediately upon egress from the sip hole and exposed to atmosphere. This thermal differential is created due to the varied volumetric amounts of fluid in one place compared to another. The relative volume in the cup is potentially the greatest, comparatively between the three, and therefore maintains a higher thermal mass compared to the other two. The fluid that passes through the insulation chamber is separated from the thermal mass of the cup and spread out into a relatively thin cross section, which allows for a slight cooling of the fluid just prior to egress through the sip hole.

A vent hole is located in the outer lid in the area of the lid that is generally positioned directly under the nose of the consumer such that aroma escapes from the cup to further enhance the drinking experience. The vent hole is further oriented and aligned with the internal effluent transfer drain holes such that escaping aroma from the cup is able to pass directly to and through the vent hole.

The SSRIL does not feature any passage holes located directly at bottom dead center of the SSRIL relative to the sipping tilt position such that sediment, coffee grounds, tea grounds, and the like are prevented from transfer into the insulation chamber and are thusly retained in the cup.

The atmosphere immediately outside the sip hole will cool the fluid ever so slightly from the fluid flowing through the insulation chamber. Therefore, the temperature of the fluid in atmosphere immediately outside the sip hole (Tsip) is less than the temperature of the fluid in the insulation chamber (Tins), which is less than the temperature of the fluid in the cup below the SSRIL (Tcup). This temperature differential can be expressed in the following terms:

$$Tsip<Tins<Tcup$$

The SSRIL provides an insulation chamber which creates a pressure differential between the fluid mass in the cup, the insulation chamber, and the atmosphere. This pressure differential is created due to the varied rates of speed between the flow of fluid and the speed at which the air flows through the device.

Therefore, the vapor pressure in the cup below the SSRIL (CUPpsi) is less than the vapor pressure in the insulation chamber of the SSRIL (SSRILpsi). Additionally, the vapor pressure in atmosphere immediately outside the sip hole (ATMOSpsi) is less than the vapor pressure in the insulation chamber. This vapor pressure differential can be expressed in the following terms:

$$ATMOSpsi<SSRILpsi<CUPpsi$$

The outer layer provides a secondary insulation barrier to that of the inner layer. The outer layer also provides a location for the sip hole such that a labyrinth path is formed between the transfer holes and the sip hole.

The inner lid layer is contoured such that the forces of axial fluid wave motion are deflected radially away from the outer lid layer and toward the cup lip seal. The force of the redirected wave motion acting radially against the cup lip tries to expand the cup lip ring, but hoop strength of the cup lip ring and the snap fit of the outer lid layer over the cup lip ring provide substantial hoop strength, resulting in a tighter seal between the cup lip and the outer lid. The chamber between the inner lid layer and the outer lid layer provides a buffer space that collapses slightly as the wave motion acts against it, absorbing the brunt of the axial wave motion force. The slightly collapsed space of the chamber prevents the axial wave motion force from acting directly against the outer lid layer, preventing it from becoming dislodged by the axial wave motion force.

The inner lid layer is contoured such that the forces of exploding projectile food particles in devices such as microwave ovens are deflected radially away from the outer lid layer and toward the cup lip seal. The force of the redirected exploding projectile food particles acting radially against the cup lip tries to expand the cup ring, but hoop strength of the cup lip ring and the snap fit of the outer lid layer over the cup lip ring provide substantial hoop strength resulting in a tighter seal between the cup lip and the outer lid. The chamber between the inner lid layer and the outer lid layer provides a buffer space that collapses slightly similar to a trampoline as the exploding projectile food particle acts against it, absorbing the brunt of the food particle projectile force and repelling it away. The slightly collapsed space of the chamber prevents the food particle projectile force from acting directly against the out lid layer, preventing it from becoming dislodged as a result of impact from an exploding food particle.

Those skilled in the art will also appreciate there are many other variations on the theme and numerous applications of the subject invention's features that may not be exhaustively articulated in this disclosure, but still embody the spirit and intentions of this disclosure. Those skilled in the art will readily understand that the features disclosed in the SSRIL are suitably manufactured from any of the known lid materials and/or using any one of the well known lid manufacturing methods.

Those skilled in the art will readily appreciate there are numerous methods that can be employed to mate the inner lid layer with the outer lid layer. Said methods include friction, interference fits, hot staking, gluing, adhesives, adhesive films, melting, sonic welding, mechanical interlocking, snap fits, and many other common methods, all of which are suitable for high-volume, cost-effective manufacturing.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
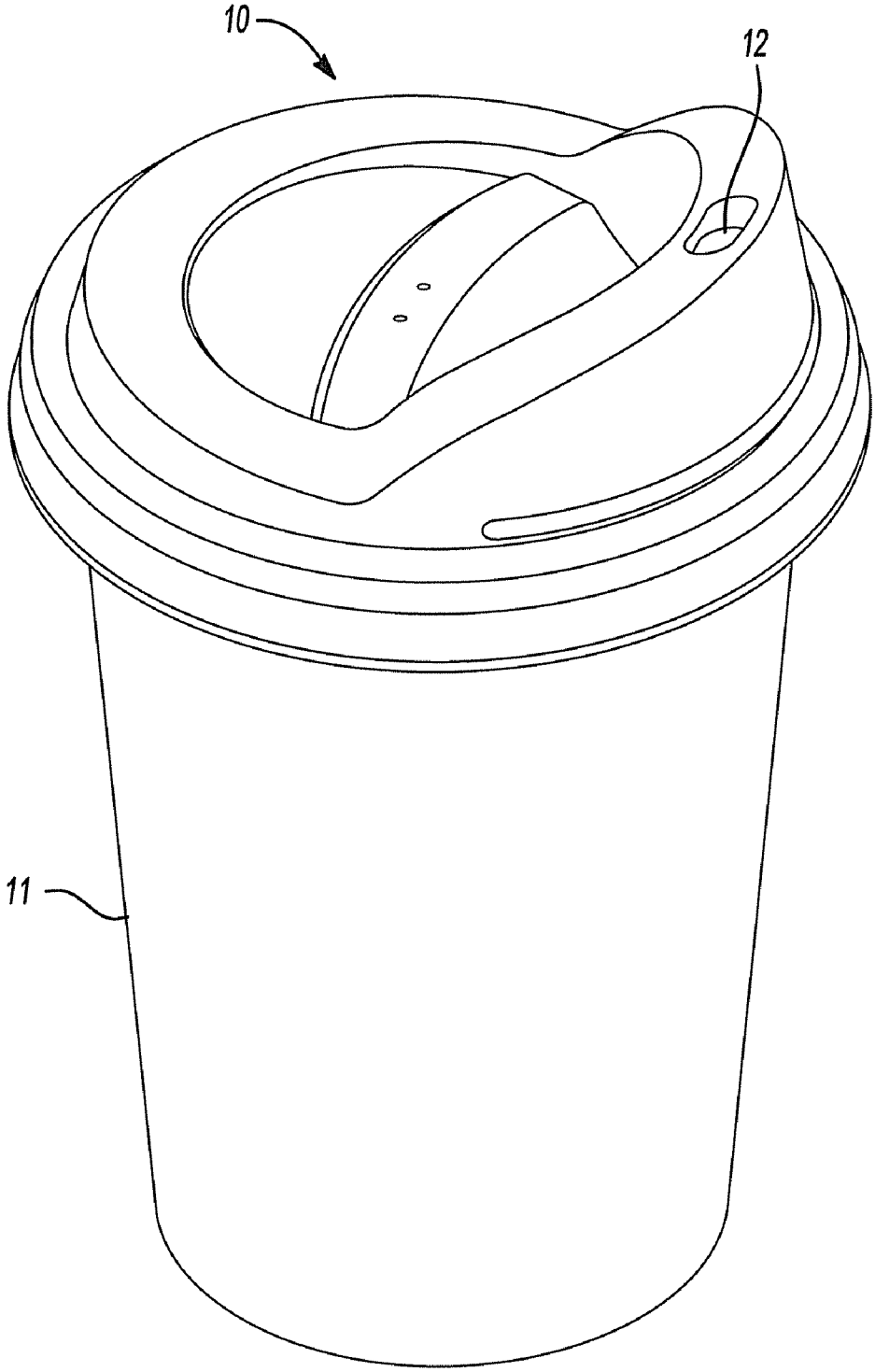
FIG. 1 is a perspective view of the primary embodiment of the splash and spill resistant insulating lid attached to a beverage container.
Figure 2:
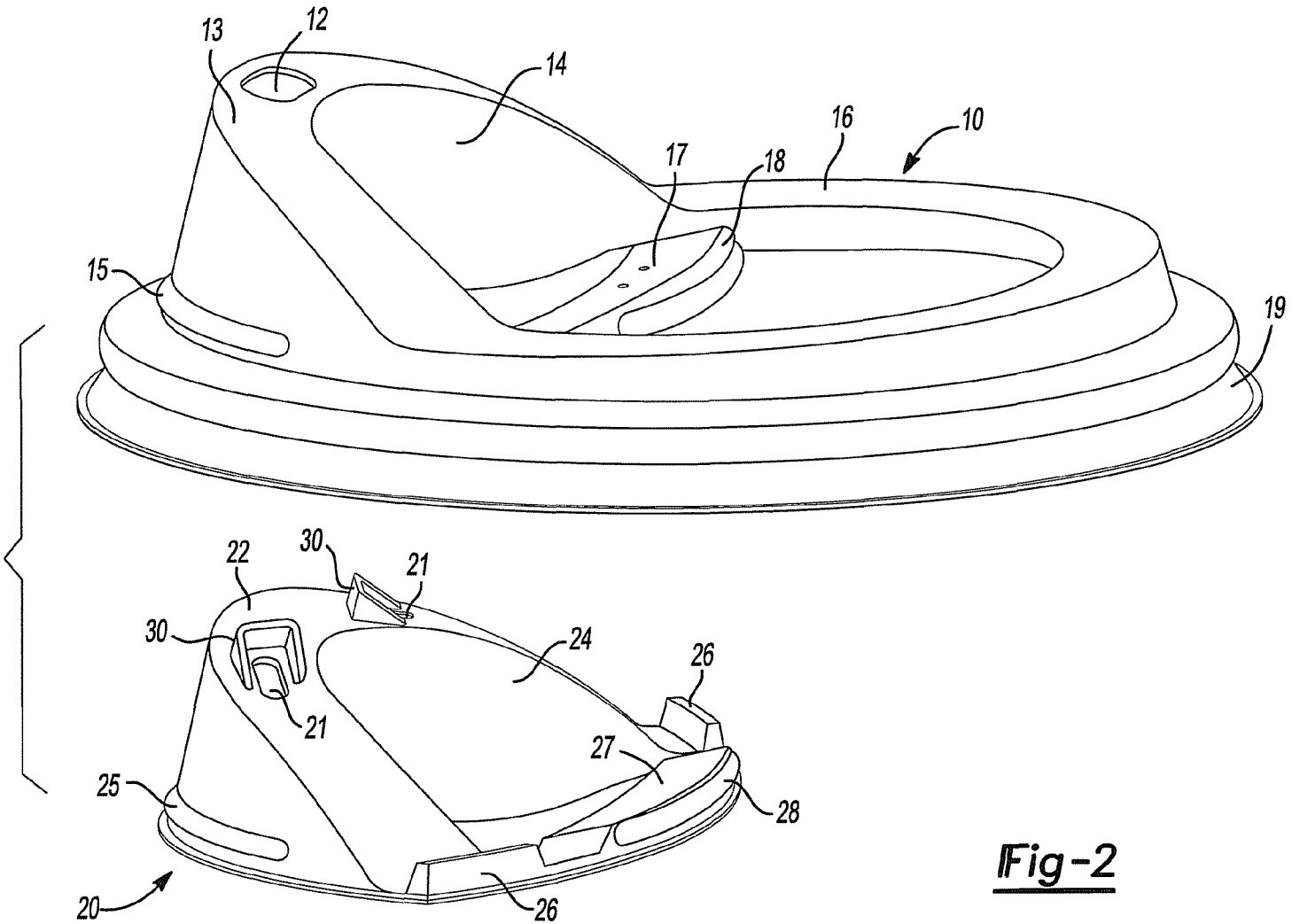
FIG. 2 is a perspective, unassembled view of the two components comprising the lid of FIG. 1.
Figure 3:
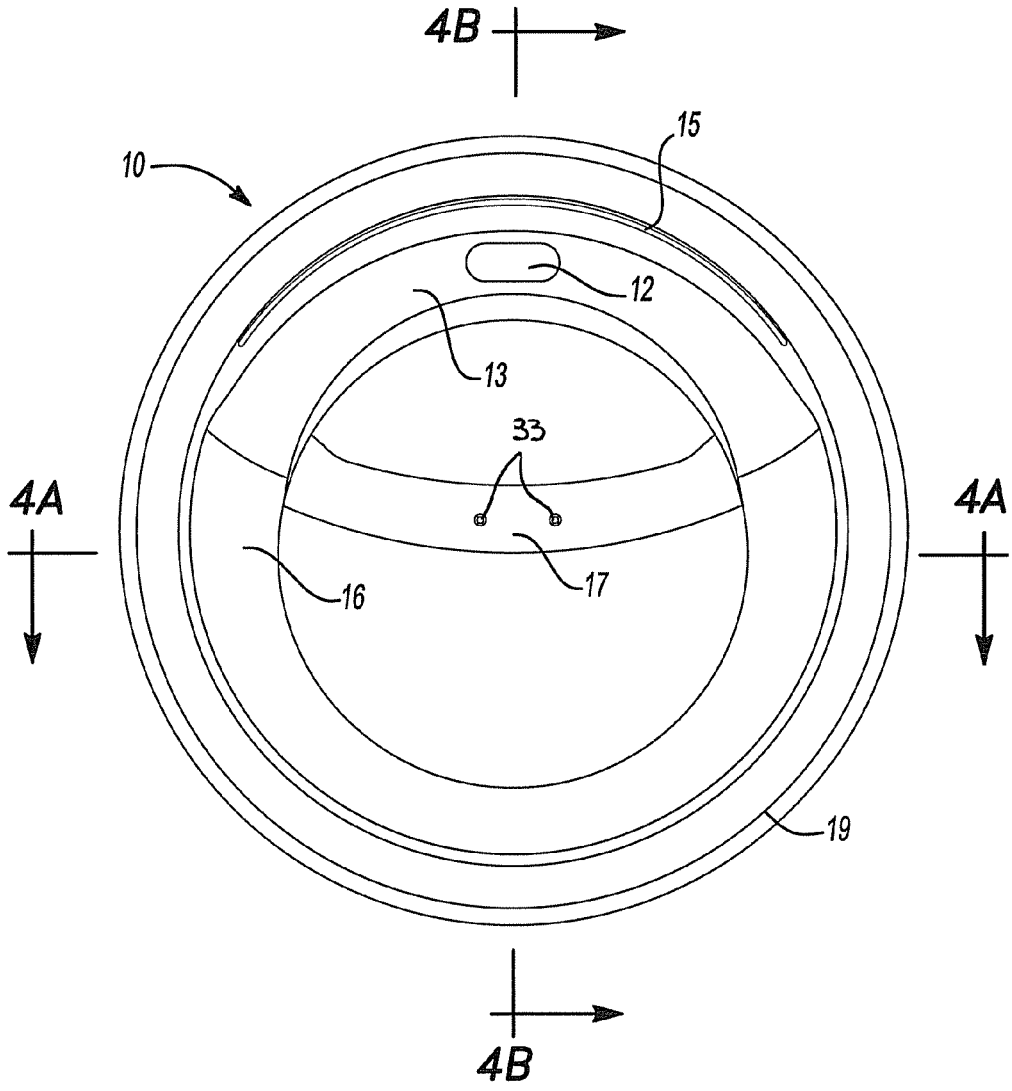
FIG. 3 is a top view of the splash and spill resistant insulating lid.

The following description is merely exemplary in nature and is not intended to limit the present disclosure, application, or uses. It should be understood that throughout the drawings, corresponding reference numerals indicate like or corresponding parts and features.

Referring now to the figures, in particular, FIG. 1, the primary embodiment of the present invention is shown as a splash and spill resistant insulating lid 10 attached to a beverage container 11. The lid 10 snap-fits frictionally to the lip formed on the top of the beverage container 11, and comprises a drinking aperture 12 positioned on top of one end of the lid 10.

Referring now to FIGS. 2 through 4B, the lid 10 is shown with inner element 20 prior to assembly. The lid element 10 is generally circular in shape and comprises a circumferential flange 19 which sealingly snap-fits against the lip of a beverage container. A raised, annular portion 16 is molded into the top of the lid 10 and comprises a heightened drinking spout portion 13 positioned at the front portion of the lid 10. The spout portion 13 comprises an inner wall 14 proximal the center of the lid 10 and an outer wall proximal the outside diameter of the lid having a horizontal relief ridge 15 molded therein for frictionally holding the front portion of the inner element in place when assembled therewith.

Positioned within the confines of the raised annular portion 16 proximal the center of the lid 10, an arcuate, raised vent portion 17 is formed in the lid 10, defining a depression between the vent portion 17 and the inner wall 14 of the spout portion 13. The raised vent portion 17 has at least one vent hole 33 positioned through the lid 10, proximal the top of the vent portion 17, allowing air exchange between the chamber 29 formed when the inner element 20 is attached to the lid 10 (and ultimately the beverage container itself) and the outside atmosphere. A horizontal center ridge 18 is molded within the rear of the vent portion 17 for frictionally holding the rear portion of the inner element in place when assembled therewith.

The inner element 20 is complementary to the front portion of the lid 10, and comprises a small flange around its perimeter which seals against the bottom surface of the lid when attached thereto. Raised, pouring ridge 22 is molded into the inner element 20 comprising inner wall 24, and is complementarily received within the spout portion 13 of the lid 10. A pair of raised, beverage access apertures 21 are located on the top of the pouring ridge 22, off center and staggered from the drinking aperture 12 located in the lid 10, so as to prevent a direct line of travel of the beverage from the container to the drinking aperture 12 and ultimately the consumer.

A frontal horizontal ridge 25 is also molded in the lower portion of the front side of the pouring ridge 22, which is complementary to the horizontal relief ridge 15 of the lid 10 and, when received therein, frictionally holds the front portion of the inner element 20 to the front side of the lid 10 in a snap-fit fashion.

Proximal the rearward portion of the inner element 20 near the center of the lid 10 is an arcuate, raised portion 27 formed in the inner element, defining a depression between the raised portion 27 and the inner wall 24 of the pouring ridge 22. This raised portion 27 is complementary to the raised vent portion 17 of the lid 10, and further comprises a rearward projecting, horizontal ridge 28 which is complementary to the horizontal center ridge 18 of the lid 10 and, when received therein, frictionally holds the rear portion of the inner element 20 to the center lid 10 in a snap-fit fashion. Vent ridges may also be implemented within said inner element directly below the vent holes in the lid.

Figure 4A:
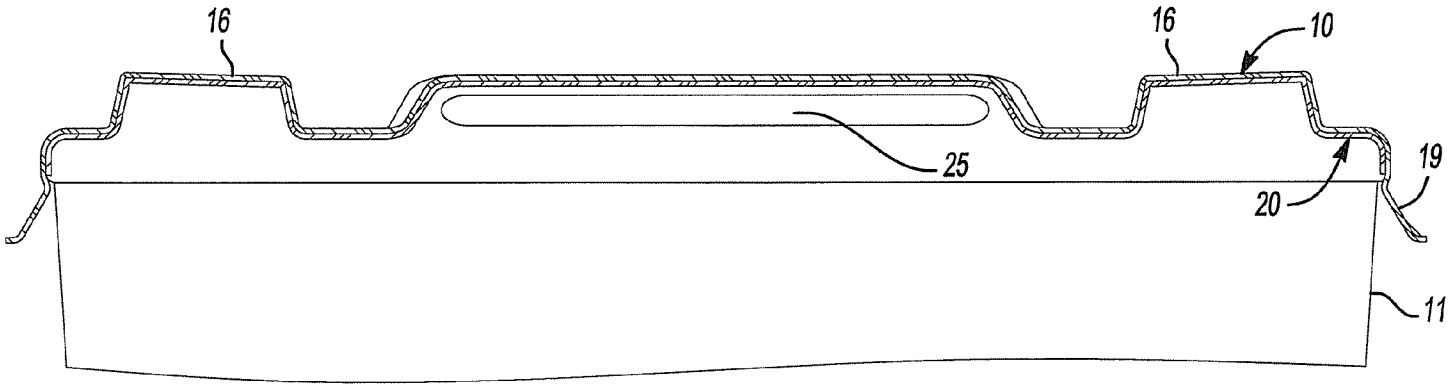
FIG. 4A is a cross-sectional side view of the assembled lid taken along line 4A of FIG. 3.
Figure 4B:
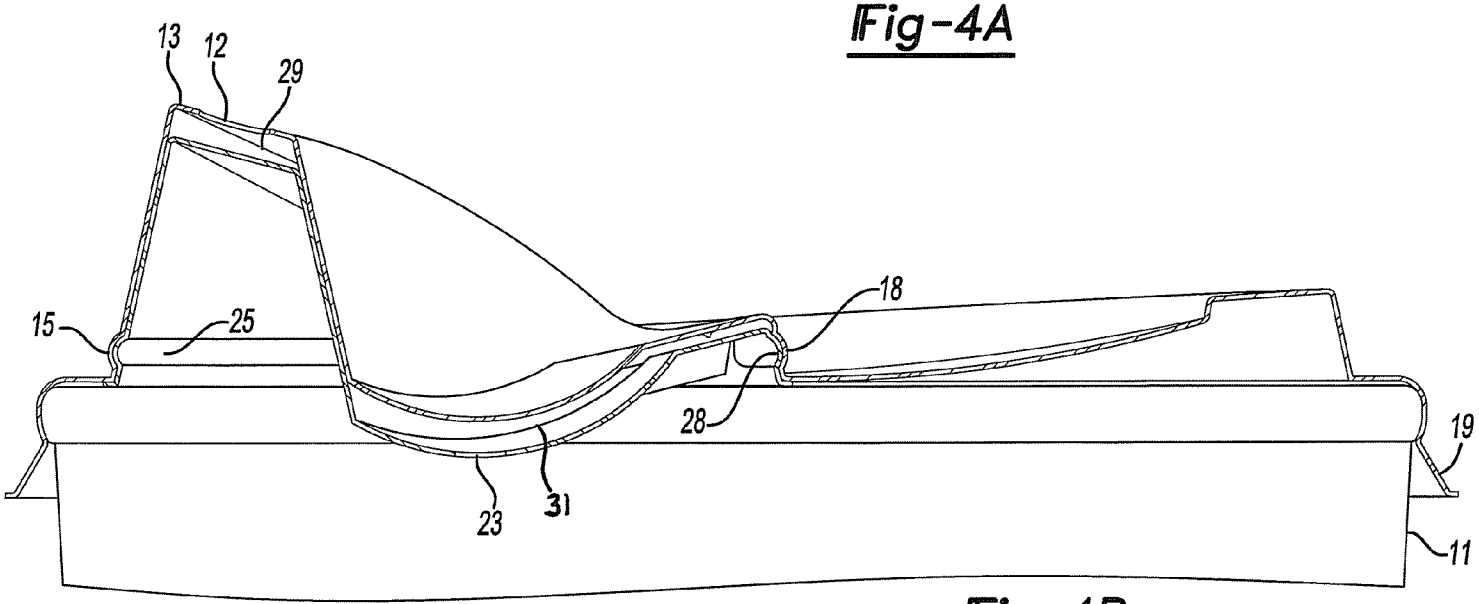
FIG. 4B is a cross-sectional side view of the assembled lid taken along line 4B of FIG. 3.

A pair of raised tabs 26 are formed in the inner element 20, positioned on either side of the raised portion 27, which are complementary to and received within the raised annular portion 16 of the lid 10, diverting any unconsumed beverage remaining between the lid 10 and the inner element 20 towards the depression in the center of the inner element, wherein drain aperture 23 is located (as shown in FIG. 4B), allowing the unconsumed beverage to drain back into the beverage container.

Figure 5A:
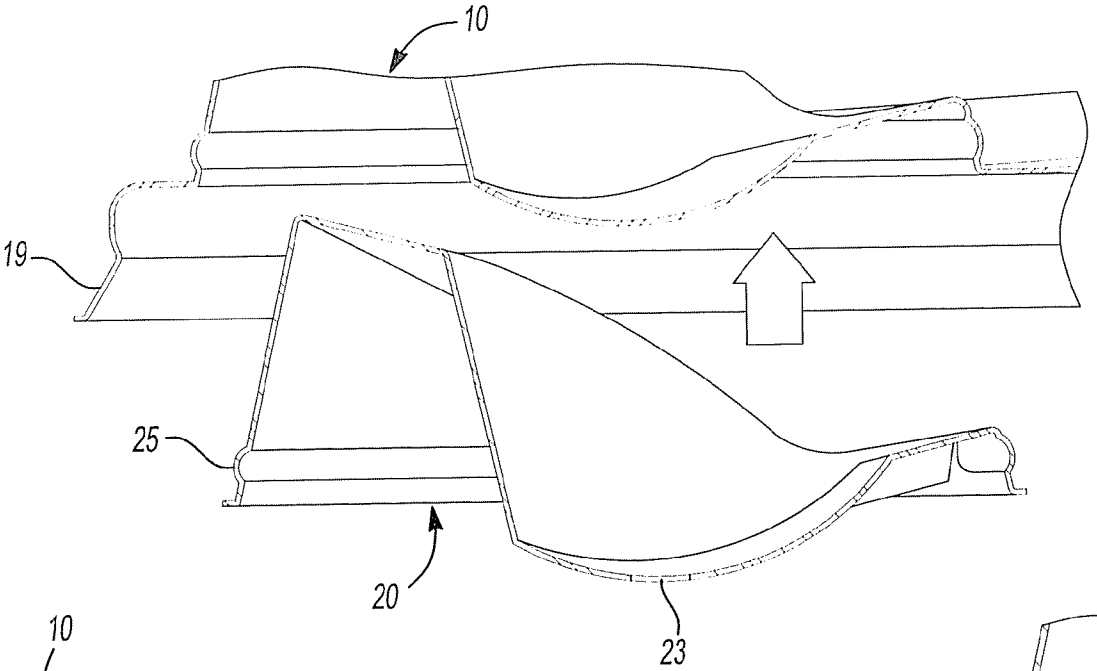
FIG. 5A is a partial, pre-assembled side view of the two components comprising the lid.
Figure 5B:
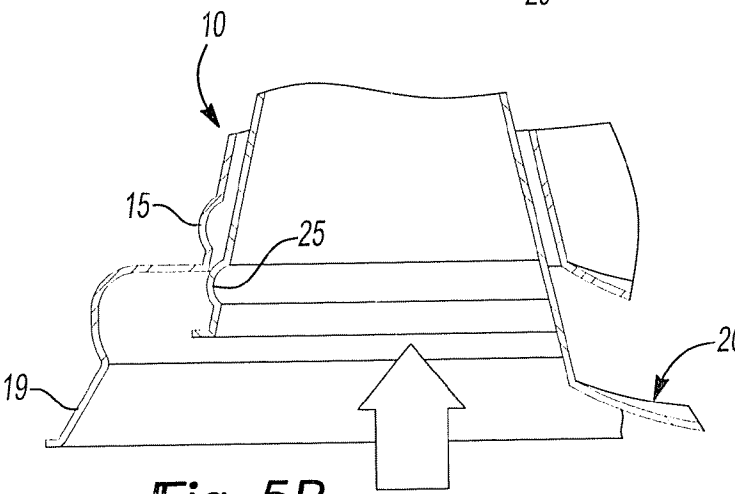
FIG. 5B is a partial side view of the two components comprising the lid during assembly.
Figure 5C:
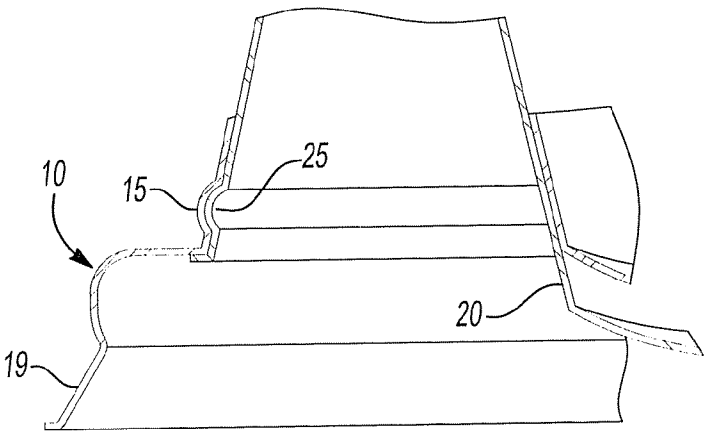
FIG. 5C is a partial side view of the two components comprising the lid after assembly.

Referring now to FIGS. 5A-5C, the assembly of the lid and inner element 20 is shown in progression. Following the figures in order, the inner element 20 is aligned underneath the lid 10, wherein the complementary pouring ridge 22 is aligned with the spout portion 13 of the lid 10 to the front portion of the lid 10. Raised, pouring ridge 22 is molded into the inner element 20 comprising inner wall 24 and is complementarily received within the spout portion 13 of the lid 10. As the inner element 20 is inserted into the bottom of the lid, frontal horizontal ridge 25 engages with the horizontal relief ridge 15 of the lid, frictionally snap-locking the inner element 20 to the lid. When assembled, a small chamber is formed between the top of pouring ridge 22 and the spout portion of the lid, allowing the beverage within the container to cool slightly while traveling through the gauntlet from beverage access apertures 21 to the drinking aperture 12 in the lid.

Alternative embodiments which are also intended to be within the scope of the present invention include providing a means for opening the SSRIL device so that additives (e.g., cream and sugar) can be introduced into the thermal mass without removing the subassembly from the cup or vessel.

Another variation on the theme allows the anti-splash device to be easily removed from the cup or vessel by implementing a simple thumb and/or finger pull tab. The removal tab or tabs allow easy subassembly removal in a controlled and safe manner compared to traditional lids.

Another variation on the theme provides for the subassembly to be removed from the cup or vessel and then hung on the side of the cup or vessel in lieu of holding the lid in the consumer's hand or placing the subassembly down on the counter or other undesirable surface. The subject invention provides several variant hanging methods for the subassembly on the lip of the cup or vessel. Some of the variants include simply hanging on the side using a stationary formed structural hook. Another variant uses a hook structure that is formed via the consumer bending a tab over into a new position, which results in a hook geometry being formed. Another variant provides a hook geometry and structure which pinches and/or impinges upon the lip of the cup or vessel to secure the subassembly and yet allow easy removal for reassembly onto the cup or vessel.

Another variation on the theme provides a riser structure extending upward from the transfer holes and/or downward back into the cup. Said riser structure provides side surfaces at the transfer holes to channel the flow through them. Said riser structures may extend upward toward the outer lid layer and match cooperating structural geometry of the outer lid layer to maximize flow diversion and/or flow direction and/or flow energy absorption and dissipation of sloshing and splashing. Said risers may extend downward back into cup to provide a difficult egress target for sloshing and splashing fluid trying to find an escape through either the influent and/or effluent transfer holes. A further variation on this theme provides riser structures with frustum, funnel 31, or tapered walls relative to each other, such that the tapered riser surfaces further improve the efficiency of the structure to restrict sloshing and/or splashing flow through the transfer holes. When said riser structures extend upward from the effluent transfer drain holes, then appropriate openings, such narrow slots, gaps, mouse holes, et cetera, are provided to allow gravity return drainage of the fluid in the insulation chamber back to the cup.

Another variation on the theme is to provide a SSRIL with an inner lid layer and an outer lid layer with specific geometry cooperating between the two layers such that the fluid flow path is restricted and guided through a relative maze and/or labyrinth flow path after it passes through the influent transfer holes on its way to the sip hole. The cooperating geometry between the two lid layers may be organized to provide a relatively straight and direct flow path back to drain from the sip hole. The cooperating geometry between the lid 10 and the inner element 20 in combination with the ramped flow channels prevents the fluid in the insulation chamber from draining back through the relative maze and is forced to drain directly back to the drain holes.

Another variation on the theme provides a fiber-type insulation and/or filter media in between the inner lid layer and the outer lid layer. Said filter media may be selected to provide capability to capture and filter coffee and/or tea grounds, for example. In addition, and/or alternatively, said media may provide an extra layer of insulation to maintain thermal levels for greater periods of time than possible with out it.

Another variation on the theme is to provide an inner lid layer with specifically organized pleat shapes around the edge of the turned-up lip. Said pleat shapes are reminiscent to the pleats on a typical Coca-Cola™ bottle top where the metal is crimped and pleated to retain it around the lip of the bottle. Said pleats in the inner lid layer will be of a finite number and in a specific orientation to provide restrictive interference between the inner lid layer and the outer lid layer. Said pleats are also shaped such that fluid can pass through them such they provide the function of the influent transfer holes.

Another variation on the theme is to provide a single outer lid layer with a deep well structure located extending downward into the cup. Said deep well is located such that additional outer lid geometry provides appropriate sipping shapes and recessed clearance for the lip and nose. Said deep well is outfitted with specific shaped transfer openings to allow fluid flow into the deep well, while at the same time restricting easy ingress of sloshing and/or splashing fluid into the deep well. Said transfer holes are located in a finite number and in an appropriate orientation so as to provide maximum flow during sipping and minimized flow due to sloshing and splashing. If desired, a variation of this variation provides the outer lid layer to be designed such that it can be outfitted with an insulating and/or filter media to provide extra insulation value from an otherwise single-layer lid. Said single-layer lid design is very economical to manufacture compared to a multi-layer lid design. Said single-layer lid design is also easy to incorporate an opening suitable for introducing cream and sugar and other beverage additives without removing the lid from the cup.

Another variation on the theme is that a conventional straw can be inserted through the sip hole of the outer lid layer and through a weakened area in the inner lid layer directly under the sip hole to allow use of a conventional straw without removing or replacing the lid. Another variation on the theme is that the subject invention can be manufactured from heavy materials for lid applications on re-useable travel mugs and/or other non-disposable beverage containers. The subject invention can be combined with many other prior art technologies, such as a sliding closure tab, without violating the spirit and intention of the subject invention.

What is claimed is:

1. A splash and spill resistant insulating lid for beverage containers comprising:

an outer lid, said outer lid sealing and detachably attaching to a top portion of said beverage container, and having a raised spout portion on a first end with a beverage dispensing aperture on a top of said raised spout portion, and at least one vent hole located proximal a center of said lid positioned on a second raised vent portion separate from said first raised spout portion;

an inner element, said inner element being complementary to said outer lid, and detachably attaching to a bottom side of said outer lid, said inner element having a raised pouring ridge on a first end, complementary and nestingly received within the raised spout portion of said outer lid, defining a chamber there between said raised pouring ridge and said raised spout portion, said raised pouring ridge having at least one aperture positioned offset from said beverage dispensing aperture of said outer lid, but in fluid connection with said beverage dispensing aperture, said inner element further defining a central raised portion proximal the center of said outer lid, complementary to said second raised vent portion of the outer lid, defining a depression between said raised pouring ridge and said central raised portion and forming a second chamber between said central raised portion and said second raised vent portion of the outer lid, wherein said depression comprises at least one drain aperture in fluid connection with said first chamber and said second chamber, and where said at least one drain aperture is offset from said at least one vent hole located on said outer lid, said inner element being substantially smaller than said outer element, wherein said first and second chambers are substantially smaller than the outer lid, and said inner element features an accurate surface that is formed convex toward the beverage container.

2. The splash and spill resistant insulating lid of claim 1, wherein said at least one vent hole is of a round shape.

3. The splash and spill resistant insulating lid of claim 1, wherein said at least one vent hole comprises two separate vent holes, positioned in said outer lid so that each of said two separate vent holes is positioned proximal to each of a consumer's nostrils when consuming a beverage through said splash and spill resistant insulating lid, said vent holes formed by punching into the outer lid by a punching means such that a tapered, funnel structure is created extending into the chamber, said funnel like structure providing a deterrent structure against the likelihood of liquid within said beverage container splashing through the vent hole.

4. The splash and spill resistant insulating lid of claim 1, wherein said at least one vent hole is sized according to the viscosity of the beverage desired to be consumed utilizing the splash and spill resistant insulating lid.

5. The splash and spill resistant insulating lid of claim 1, wherein a vent channel is formed in said inner element below each of said at least one vent hole in said lid, said vent channel providing positive drain back surfaces toward said drain aperture and prevent any buildup of fluid immediately adjacent to the vent holes.

6. The splash and spill resistant insulating lid of claim 5, wherein said vent channel provides an air movement capacity in excess of the volume of air that can move through the vent holes.

7. The splash and spill resistant insulating lid of claim 5, wherein said vent channel is inclined towards the surface of the fluid in the reservoir providing drainage for any fluid that finds its way into the vent channel into the drain aperture.

8. The splash and spill resistant insulating lid of claim 1, wherein the combination of the outer lid and an inner element provides insulation to minimize heat loss due to said inner element being in close enough proximity to said outer lid so to prevent direct vertical escapement of heat within the beverage container.

9. The splash and spill resistant insulating lid of claim 1, wherein the combination of said outer lid and said inner element provide a labyrinth through which heat and liquid must traverse in order to escape through said beverage dispensing aperture, wherein said labyrinth initially directs said liquid and said heat away from said beverage dispensing aperture prior to redirecting it towards said beverage dispensing aperture.

10. The splash and spill resistant insulating lid of claim 1, wherein the proximity of said outer lid and said inner element provide for a seal to be formed from the surface tension of the liquid once a consumer takes a drink from residual liquid located around the beverage dispensing aperture.

11. The splash and spill resistant insulating lid of claim 1, wherein the at least one aperture on said raised pouring ridge comprises at least one slot-shaped hole, positioned adjacent said beverage dispensing aperture, wherein said at least one slot-shaped hole further comprises a wall formed there around which contacts and touches the underside of the outer lid, said wall formed on three sides of said slots, leaving one side open directed away from said beverage dispensing aperture.

12. The splash and spill resistant insulating lid of claim 11, wherein the at least one aperture on said raised pouring ridge has a first axis datum line that runs through said at least one aperture along the length of the slot, and said beverage dispensing aperture has a second axis datum running through said beverage dispensing aperture, wherein said first axis datum of the at least one aperture is oriented at an angle to said second axis datum line of said beverage dispensing aperture.

13. The splash and spill resistant insulating lid of claim 12, wherein the fluid in the reservoir defines a datum line horizon due to gravity, said reservoir horizon datum is parallel to the axis datum line of said beverage dispensing aperture.

14. The splash and spill resistant insulating lid of claim 13, wherein the at least one slot-shaped hole is oriented such that the slot adjacent to the beverage dispensing aperture allow a freer flow through them compared to the at least one slot-shaped hole farthest from the dispensing aperture, none of said at least one slot-shaped holes are oriented parallel or transverse to the horizon datum of the reservoir.

15. The splash and spill resistant insulating lid of claim 1, wherein said outer lid comprises a recess in an outer layer of the outer lid that a drinker's nose can recess into while drinking through the lid.

16. The splash and spill resistant insulating lid of claim 1, wherein the beverage dispensing aperture is not parallel to a defined surface of the fluid reservoir when the beverage container is in the upright position.

17. The splash and spill resistant insulating lid of claim 10, wherein the surface of an inner layer of the inner element immediately adjacent to the beverage dispensing aperture is parallel to the surface of an outer layer of the outer lid at the beverage dispensing aperture to facilitate an even formation of a surface tension bubble barrier.

18. The splash and spill resistant insulating lid of claim 1, wherein the inner element cooperates with the outer lid by snapping into a receiving groove formed between the two mating portions, and said mating groove formed between the two lid portions does not extend around the perimeter of the inner lid layer in a continuous fashion, rather the mating groove is interrupted and discontinuous.

19. The splash and spill resistant insulating lid of claim 1, wherein the convex inner element surface is designed to flex in response to the fluid momentum and collapse upward toward the outer lid layer, absorbing and dissipating some of the energy and fluid momentum.

20. The splash and spill resistant insulating lid of claim 19, wherein the drain aperture is located in the bottom of the convex inner element layer surface, wherein when the inner lid layer is flexed upward toward the outer lid layer in response to vertical fluid momentum, the drain aperture is pressed against the underside of the outer lid, thereby forming an effective seal preventing liquid from passing through the drain aperture and into the chamber.

* * * * *